US005511265A

United States Patent [19]

Caputo

[11] Patent Number: 5,511,265

[45] Date of Patent: Apr. 30, 1996

[54] FABRIC CLEANING AID AND METHOD THEREOF

[76] Inventor: Ralph N. Caputo, 2724 S. Yucca, Mesa, Ariz. 85202

[21] Appl. No.: 355,063

[22] Filed: Dec. 13, 1994

[51] Int. Cl.[6] ..... D06F 39/00

[52] U.S. Cl. ..... 8/159; 68/29; 68/30

[58] Field of Search ..... 68/29, 30; 8/158, 8/159

[56] References Cited

U.S. PATENT DOCUMENTS

| | | | |
|---|---|---|---|
| 8,921 | 5/1852 | Hollingsworth . | |
| 16,190 | 12/1856 | Roland . | |
| 20,791 | 7/1858 | Harrison . | |
| 29,638 | 8/1860 | Threlkeld . | |
| 30,331 | 10/1860 | Lanham | 68/30 |
| 32,469 | 6/1861 | Collier . | |
| 39,341 | 7/1863 | Danner | 68/30 |
| 53,052 | 3/1866 | Smith | 68/30 |
| 68,851 | 9/1867 | Denison | 68/30 |
| 99,450 | 2/1870 | Lockie | 68/30 |
| 109,836 | 12/1870 | Osgood | 68/30 |
| 174,747 | 3/1876 | Tarr | 68/30 |
| 245,663 | 8/1881 | Rowley et al. | 68/29 |
| 383,683 | 5/1888 | Allen | 68/30 |
| 617,405 | 1/1899 | Pett | 68/30 |
| 1,063,841 | 6/1913 | Stelter | 68/30 |
| 2,978,850 | 4/1961 | Gleszer . | |
| 4,575,887 | 3/1986 | Viramontes . | |
| 4,750,227 | 6/1988 | Hopkins et al. . | |
| 4,765,100 | 8/1988 | Majors . | |
| 4,954,138 | 9/1990 | Butcher et al. . | |
| 5,093,948 | 3/1992 | Val et al. | 8/159 |
| 5,245,722 | 9/1993 | Dameron | 68/29 |
| 5,367,734 | 11/1994 | Terry | 8/159 |

FOREIGN PATENT DOCUMENTS

| | | | |
|---|---|---|---|
| 3129699 | 2/1983 | Germany | 8/159 |

*Primary Examiner*—Frankie L. Stinson

*Attorney, Agent, or Firm*—Jordan M. Meschkow; Lowell W. Gresham; Mark M. Takahashi

[57] ABSTRACT

A cleaning aid for fabric washing machines is provided that improves the cleaning ability without using environmentally damaging detergents, excess water or longer cleaning cycles. The cleaning aid uses scrubbing devices having different buoyancy. The different buoyancy result in the scrubbing devices being distributed throughout the fabric cleaning machine, assuring that most areas of the fabric in the machine are benefited. The fabric scrubbing devices can be made with a material such as plastic or rubber. The scrubbing devices can be covered with flexible bristles to enhance their scrubbing ability. The shape of the bristles can be manipulated for particular uses. The resulting combination is a cleaning aid that can be used in conventional washing machines and improve the washing ability of these machines without damaging environmental side effects.

11 Claims, 1 Drawing Sheet

FABRIC CLEANING AID AND METHOD THEREOF

FIELD OF THE INVENTION

This invention relates generally to fabric cleaning devices and, more specifically, to clothes washing machines and methods thereof.

BACKGROUND

Prior methods and devices for enhancing the cleaning ability of fabric cleaning machines have had environmentally harmful side effects. For example, prior methods have used increased detergents and water that can result in increased pollution. Other methods have used longer cleaning cycles, resulting in more energy expended during the cleaning. Therefore, what is needed is a method for enhancing the cleaning ability of fabric cleaning machines without the harmful environmental side effects.

SUMMARY

The present invention has several advantages over prior methods. First, the present invention has the advantage of providing a cleaning aid that enhances cleaning throughout the fabric cleaning machine. Second, the present invention has the advantage of increasing cleaning without the use of environmentally harmful chemicals. Finally, the present invention has the advantage of being reusable, providing the associated environmental benefits.

The above and other advantages are provided by a cleaning aid that uses scrubbing devices with different buoyancy. The different buoyancy provides cleaning enhancement throughout the cleaning machine. If desired, flexible bristles can be used to enhance the performance of the scrubbing devices.

DETAILED DESCRIPTION OF THE DRAWINGS

The new method and apparatus provided for enhancing the cleaning ability of fabric cleaning machines use several scrubbing devices that are placed inside the fabric cleaning machine. The several scrubbing devices have different buoyancy, making them float at different levels in the cleaning machine. Having scrubbing devices with different buoyancy provides increased scrubbing throughout the entire fabric cleaning machine. The scrubbing devices have the additional advantage of being reusable almost indefinitely.

In one embodiment the scrubbing devices are rubber balls having flexible protrusions shaped to enhance their cleaning ability. The flexible protrusions of the scrubbing devices can be shaped to meet particular cleaning needs.

Figure 1:
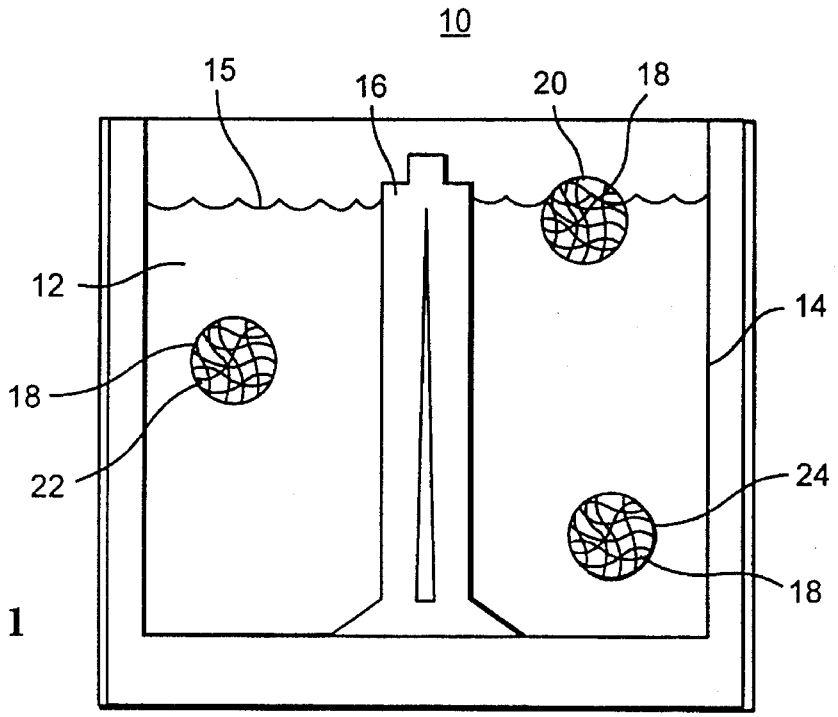
FIG. 1 is a schematic cross-sectional side view of a fabric washing machine using a cleaning aid.

Turning now to the figures for a more detailed description of the preferred embodiments, FIG. 1 is a schematic cross-sectional side view of a fabric washing machine using a cleaning aid according to the present invention. FIG. 1 illustrates a fabric washing machine 10. In one embodiment the fabric washing machine 10 could be a conventional clothes washing machine, either a commercial or home model. In this figure, the washing machine 10 is illustrated as a conventional rotary-type washer, however, the present invention could easily be used with other types, such as tumble-type washers.

The washing machine 10 uses a liquid medium 12, usually water containing various detergents as a cleaning medium. The liquid medium 12 is contained in a tub 14 during the washing cycle. The liquid medium 12 has a top surface 15. During the normal washing cycle, a liquid agitator 16 turns the liquid medium and fabric inside the machine to clean the fabric.

According to the present invention, a cleaning aid 18 is added to the liquid medium 12 to enhance the cleaning ability of the machine 10. In the illustrated embodiment, the cleaning aid 18 comprises a first scrubbing device 20. The first scrubbing device 20 is designed to have a buoyancy such that it floats at or near the top surface 15 of the liquid medium 12. This buoyancy can be achieved using a scrubbing device 20 with a hollow air tight core. Of course, other designs can result in a floating scrubbing device 20. The scrubbing device 20 can be made of rubber, plastic or other semi-rigid material that will not damage the cleaning machine 10.

A second, additional scrubbing device 22 is also added in accordance with the illustrated embodiment. The additional scrubbing device 22 has a different buoyancy than the first scrubbing device 20. In the illustrated embodiment, the additional scrubbing device 22 is slightly weighted, changing its buoyancy such that it sinks to a lower level in the liquid medium 12. Likewise, in the illustrated embodiment another additional scrubbing device 24 is added that is weighted such that it sinks near the bottom of the liquid 12. Of course, additional scrubbing devices with different buoyancy can be added depending upon particular use.

The combination of the scrubbing devices 20, 22 and 24 result in the enhancement of the cleaning ability of the cleaning machine 10 for fabrics throughout the tub 14 without the use of environmentally damaging detergents and bleaches.

Several different combinations of scrubbing devices 20, 22 and 24 can be used depending on particular needs. For example, a cleaning aid could comprise two floating scrubbing devices 20, three slightly weighted scrubbing devices 22 and two sinking scrubbing devices 24. Of course, a cleaning aid could also comprise equal numbers of the different scrubbing devices 20, 22 and 24.

Figure 2:
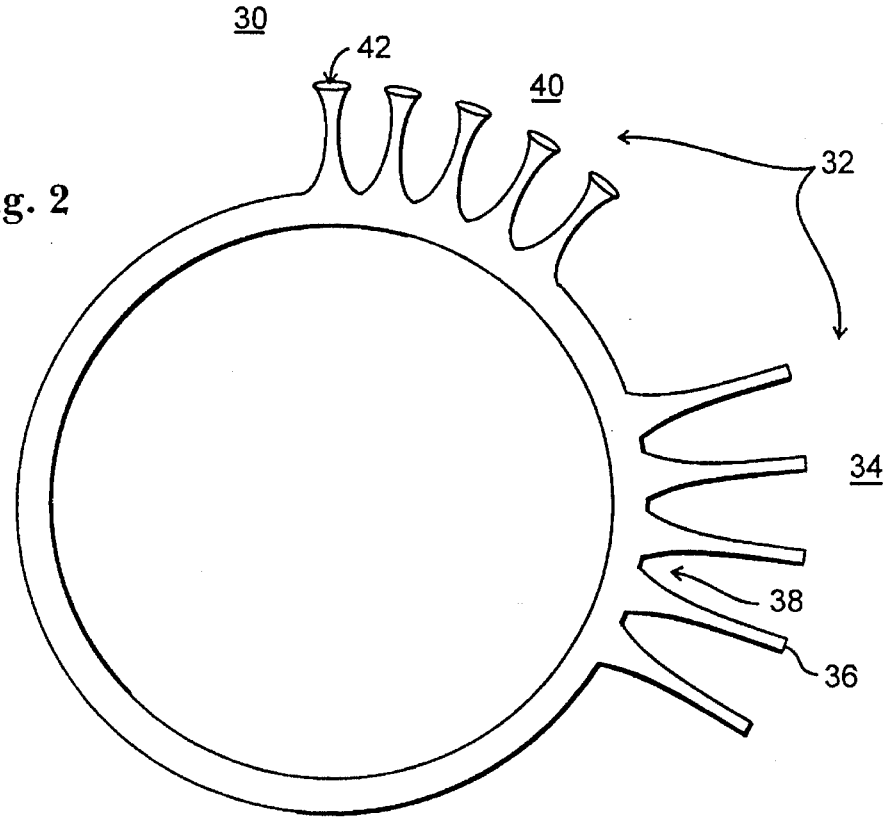
FIG. 2 is a cross-sectional side view of a scrubbing device.

Turning now to FIG. 2, FIG. 2 is a cross-sectional side view illustrating a scrubbing device 30. The scrubbing device 30 may play the role on any of the scrubbing devices 20, 22 or 24 illustrated in FIG. 1. Preferably, the scrubbing device 30 has a 3.5 inch diameter. The scrubbing device 30 is covered with protrusions 32. In one embodiment the protrusions 32 are made of a flexible material such as rubber. Other embodiments can use stiffer materials to meet specific cleaning needs. To illustrate, two different types of protrusions are shown on scrubbing device 30. The first group of protrusions 34, are tapered bristles with a narrow top 36 relative to their base 38. The second group of protrusions 40, are stems with an expanded top surface 42. The selection of a protrusion type can be based to maximize cleaning in particular applications. Of course, other types of protrusions not shown can be used in accordance with the invention.

FIG. 2 shows a two dimensional cross-section of a scrubbing device. Those skilled in the art will appreciate that the protrusions will protrude outward in a three dimensional spherical surface. Moreover, nothing requires two different shaped protrusions on one device. Those skilled in the art will also understand that protrusions may or may not be dispersed evenly over the scrubbing device.

While the invention has been particularly shown and described with reference to the preferred embodiments thereof, it will be understood by those skilled in the art that the foregoing and other changes in form and details may be made therein without departing from the spirit and scope of the invention.

Having fully described the invention in such clear and concise terms as to enable those skilled in the art to understand and practice the same, the invention claimed is:

1. A cleaning aid for fabric washing machines that use a liquid cleaning medium, the liquid medium having a top surface, the cleaning aid comprising:

a first scrubbing device comprising an air tight hollow ball such that the air tight hollow ball floats on the liquid top surface; and at least one additional scrubbing device, the at least one additional scrubbing device having a different buoyancy than the first scrubbing device, and wherein said at least one additional scrubbing device comprises a weighted ball such that the weighted ball sinks to a depth in the liquid medium.

2. The cleaning aid of claim 1 wherein the first scrubbing device and the at least one additional scrubbing device comprise rubber balls.

3. The cleaning aid of claim 2 wherein the first scrubbing device and the at least one additional scrubbing device have surfaces covered with flexible protrusions.

4. The cleaning aid of claim 3 wherein the flexible protrusions comprise flexible tapered bristles.

5. The cleaning aid of claim 3 wherein the flexible protrusions comprise flexible stems having a top with an expanded surface.

6. A method for enhancing the cleaning of fabric comprising the steps of:

providing a fabric cleaning machine, the cleaning machine using a liquid cleaning medium having a top surface;

providing a first scrubbing device into the cleaning machine, wherein said first scrubbing device comprises an air tight hollow ball such that the air tight hollow ball floats on the liquid top surface; and providing at least one additional scrubbing device into the cleaning machine, the at least one additional scrubbing device having a different buoyancy than the first scrubbing device, wherein said at least one additional scrubbing device comprises a weighted ball such that the weighted ball sinks to a depth in the liquid cleaning medium.

7. The method of claim 6 wherein the first scrubbing device and the at least one additional scrubbing device comprise rubber balls.

8. The method of claim 7 wherein the first scrubbing device and the at least one additional scrubbing device have surfaces covered with flexible protrusions.

9. The method of claim 8 wherein the flexible protrusions comprise flexible bristles.

10. The method of claim 8 wherein the flexible protrusions comprise flexible stems having a top with an expanded surface.

11. A cleaning aid for fabric washing machines using a liquid cleaning medium, the liquid having a top surface and bottom, the cleaning aid comprising:

a first rubber scrubbing device having flexible rubber protrusions wherein the first rubber scrubbing device floats on the liquid top surface;

a second rubber scrubbing device having flexible rubber protrusions wherein the second rubber scrubbing devices is weighted such that it sinks below the liquid top surface; and a third rubber scrubbing device having flexible rubber protrusions wherein the third rubber scrubbing device is weighted such that it sinks to the liquid bottom.

* * * * *